US010864931B2

(12) United States Patent
Prestail et al.

(10) Patent No.: US 10,864,931 B2
(45) Date of Patent: Dec. 15, 2020

(54) AUTOMATIC TRAIN CONTROL SYSTEM AND CORRESPONDING METHOD

(71) Applicant: ALSTOM TRANSPORT TECHNOLOGIES, Saint-Ouen (FR)

(72) Inventors: Andy Prestail, Meudon (FR); Javier Ballesteros, Paris (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 330 days.

(21) Appl. No.: 15/961,045

(22) Filed: Apr. 24, 2018

(65) Prior Publication Data

US 2018/0312182 A1 Nov. 1, 2018

(30) Foreign Application Priority Data

Apr. 27, 2017 (FR) ..... 17 53686

(51) Int. Cl.
*B61L 27/04* (2006.01)
*B61L 15/00* (2006.01)
(Continued)

(52) U.S. Cl.
CPC ..... *B61L 27/04* (2013.01); *B61L 3/006* (2013.01); *B61L 3/008* (2013.01);
(Continued)

(58) Field of Classification Search
CPC ..... B61L 27/04; B61L 3/006; B61L 3/008; B61L 15/0027; B61L 15/0063
See application file for complete search history.

(56) References Cited

U.S. PATENT DOCUMENTS 3,964,702 A * 6/1976 Lardennois ..... B61L 23/24 246/4
2015/0274183 A1* 10/2015 Lozano ..... B61L 25/021 246/122 R
(Continued)

FOREIGN PATENT DOCUMENTS

DE 102010061878 A1 5/2012
DE 102012214481 A1 3/2014
(Continued)

OTHER PUBLICATIONS

Preliminary Search Report dated Jan. 11, 2018 during the prosecution of French Patent Application No. 1753686.

*Primary Examiner* — Hussein Elchanti
(74) *Attorney, Agent, or Firm* — Troutman Pepper Hamilton Sanders LLP

(57) ABSTRACT

This system includes a ground ATC and an on board ATC, which is switched from an "active" mode toward a "standby" mode and vice versa by a wake-up unit. In the "standby" mode, only the following components remain powered: odometry device; a main computer; a radio communication device between the on board ATC and the ground ATC; the wake-up unit. The main computer is programmed so as, in the "standby" mode, to verify that the movement of the train measured by the odometry device from the switching from the "active" mode to the "standby" mode is zero and, in the affirmative, to send the ground ATC an instantaneous position of the train using the radio communication device.

10 Claims, 3 Drawing Sheets

(51) Int. Cl.
*B61L 25/02* (2006.01)
*B61L 27/00* (2006.01)
*B61L 3/00* (2006.01)

(52) U.S. Cl.
CPC ..... *B61L 15/0027* (2013.01); *B61L 15/0063* (2013.01); *B61L 25/021* (2013.01); *B61L 25/026* (2013.01); *B61L 27/0027* (2013.01); *B61L 27/0038* (2013.01); *B61L 15/0054* (2013.01); *B61L 25/025* (2013.01); *B61L 2027/005* (2013.01)

(56) References Cited

U.S. PATENT DOCUMENTS

| | | | | |
|---|---|---|---|---|
| 2015/0307119 | A1* | 10/2015 | Ghaly | B61L 25/06 246/122 R |
| 2016/0021463 | A1 | 1/2016 | Watanabe et al. | |
| 2019/0176859 | A1* | 6/2019 | Shibasaki | B61L 15/0081 |

FOREIGN PATENT DOCUMENTS

| | | | |
|---|---|---|---|
| DE | 102013216313 | A1 | 2/2015 |
| DE | 102015203664 | A1 | 9/2016 |

* cited by examiner

AUTOMATIC TRAIN CONTROL SYSTEM AND CORRESPONDING METHOD

CROSS-REFERENCE TO RELATED APPLICATIONS

The present application claims priority from French Patent Application No. 1753686 filed Apr. 27, 2017. The entire contents of which are incorporated herein by reference.

FIELD OF THE INVENTION

The present invention relates to an automatic train control system of the type with communication-based train management, in particular of the CBTC type (Communication-Based Train Control, defined by standard IEEE 1474). The present invention more particularly relates to the component of such a system that is on board a train.

BACKGROUND

The term "train" should be understood here broadly as a guided vehicle, i.e., any type of vehicle traveling along a track, such as trains, subways, trams, etc.

It is known to manage the travel of trains on a railway network using a signaling system, including an automatic train supervision system, an interlocking system and an automatic train control system.

The automatic train supervision system (ATS) is implemented in an operational unit. It includes different subsystems that make it possible to assign a route to each train and to request the opening of a portion of this route in front of the corresponding train.

The interlocking system, or IXL system, manages the track equipment, such as illuminated signals, switching actuators, etc., to open a route for traffic by a train according to a request from the ATS system. The IXL system verifies and carries out a plurality of logic conditions and logic actions to place the various pieces of equipment of a portion of the route to be opened in a requested interlocking state. The IXL system is then said to trace the corresponding route. Formerly based on electromechanical relays, today the IXL system is based on computers. It is then called CBI system (for "computer-based interlocking").

The automatic train control (ATC) system includes different pieces of equipment cooperating with one another to allow trains to travel safely on the network.

In particular, an ATC system is known of the "communication-based train control" (CBTC) type, including a component on board each train, or on board ATC system, and a component on the ground, or ground ATC.

The on board ATC includes at least one computer on board a train, capable of determining a certain number of operating parameters of the train. The on board ATC is then capable of communicating this information to the ground ATC to allow the train to safely carry out the assignment that has been allocated to it.

The on board ATC on the one hand provides coverage of the functional needs (stopping in the various stations to be served, for example) and, on the other hand, provides the inspection of the security points (verification that the train does not have an excessive speed, for example). The on board computer of a train is connected to an onboard radio communication unit, able to establish a radio link with base stations of a ground radio communication infrastructure, to which the on board ATC, as well as the ATS and IXL systems, are connected.

On the ground, the ground ATC includes a zone controller (ZC system), in particular responsible for monitoring the presence of each train on the network, the on board ATC of each train regularly providing it with the instantaneous position of the train.

The ZC system is also responsible for providing the on board ATC of each train with a movement authorization, which guarantees the travel safety of the considered train on a track section of the railway network (for example, not giving a train a movement authorization that would allow it to go past the end of the train ahead of it).

It should be noted that, the railway network being subdivided into zones (or blocks), the occupation of a zone is determined by the ZC system from information that it receives on the one hand from a primary detection system, and on the other hand from a secondary detection system.

The primary detection system makes it possible to determine the zone occupied by a train based on the instantaneous position of the train determined by the on board ATC of the latter and communicated to the ZC system of the ground ATC. The ZC system is then able to develop a first piece of occupancy information.

The secondary detection system is able to back up the primary detection system; for instance, in the event the radio communication unit of a train is no longer working, the ZC system cannot obtain the instantaneous position of the train. Using suitable track equipment, such as axle counters or track circuits, arranged along the track, the secondary detection system is able to detect the presence of a train in a given zone and to communicate a second piece of occupancy information to the ZC system.

The ZC system reconciles the first and second piece of occupancy information. Different strategies are next implemented when these two pieces of information differ from one another. It should be noted that a ZC system sends "occupied" or "free" zone information to the IXL system, the occupancy state of the zone being part of the logic conditions verified by the IXL system to open a route.

When a train is started, its on board ATC is powered on. It needs to be able to operate immediately so as to allow a movement with supervision and safety of the train, i.e., the on board ATC operates in an "active" operating mode.

However, when the on board ATC is powered on, it cannot determine the instantaneous position of the train. It therefore cannot provide the ground ATC with the instantaneous position of the train, and the latter cannot travel on the network with full supervision. It is in fact necessary to carry out a phase for initializing the instantaneous position of the train, during which the train moves into sight on the track until it crosses a positioning beacon placed on or along the track. From information received in this beacon, the on board ATC is capable of determining the instantaneous position of the train and sending it to the ground ATC. From this moment, the on board ATC can enter the "active" operating mode, for full supervision.

One can see that this initialization phase is detrimental, in particular for driverless autonomous subways, since it is done by controlling the train by sight. In other words, the train must be taken out of the garage by a driver until it crosses a positioning beacon.

It is therefore necessary for the on board ATC to know, more quickly but still safely, the instantaneous position of the train so as to allow it to operate immediately in the "active" operating mode.

Document US 2016/0214631 A1 discloses the use of a radar device installed along garage tracks of the railway network and capable of tracking the movement of a train parked on the monitored track portion. By comparing successive radar images, the radar device is able to determine whether a particular train has been moved while its on board ATC system is off. In case of movement, an appropriate message is sent to the ground ATC. When the on board ATC is turned back on, if the ground ATC has not received the message from the radar device, it then sends the on board ATC the instantaneous position of the train at the moment when the on board ATC was turned off as the instantaneous position of the train allowing the on board ATC to operate immediately in the "active" operating mode.

Conversely, if the ground ATC receives a message from the rater device indicating a movement of the train, the ground ATC tells the on board ATC that the instantaneous position of the train is no longer known. As a result, an initialization phase of the instantaneous position of the train must be carried out, before the on board ATC can operate in the "active" operating mode.

This solution of the state of the art has the drawback of requiring the installation of a large number of radar devices along tracks of the railway network. It is therefore limited to only garage tracks for cost and maintenance reasons.

Furthermore, comparing radar images is complex and leads to many false alarms, corresponding either to the detection of a movement of the train when it has in fact remained immobilized, or the non-detection of certain events associated with the movement or unhitching of the train.

Lastly, if the ground ATC is lost, all of the positions of the trains are no longer available.

SUMMARY

The present invention aims to resolve this problem by proposing an alternative solution to that of the state of the art document presented above.

To that end, the invention relates to an automatic train control system of the type with communication-based train management, including a ground component, called the ground ATC, and an on board component that is on board a train, called on board ATC, characterized in that the on board ATC is able to be switched from an "active" operating mode to a "standby" operating mode and vice versa through a wake-up unit, in the "standby" operating mode, only the following components remaining supplied with electricity using an electrical power source: an odometry device making it possible to measure a movement of the train; a main computer; a radio communication device between the on board ATC and the ground ATC; and advantageously the wake-up unit, the main computer being programmed so as, in the "standby" operating mode, to verify that the movement of the train measured by the odometry device from a switching moment from the "active" operating mode to the "standby" operating mode is zero and, in the affirmative, to send the ground ATC an instantaneous position of the train using the radio communication device, at least at a switching moment from the "standby" operating mode to the "active" operating mode.

According to other advantageous aspects of the invention, the system comprises one or more of the following features, considered alone or according to all technically possible combinations:

- in the negative, the main computer is able to invalidate the instantaneous position of the train and not send the ground ATC an instantaneous position of the train until a predetermined moment, advantageously corresponding to the detection of a positioning beacon, placed along a railway track on which the train is traveling.
- the instantaneous position of the train sent from the on board ATC to the ground ATC is an instantaneous position of the train determined by the main computer.
- the odometry device include a member for detecting the movement of the train, the member for detecting the movement of the train advantageously comprising a phonic wheel and acquisition electronics connected to the computer.
- said on board ATC includes a first subsystem and a second subsystem, the second subsystem being redundant relative to the first subsystem, each subsystem including an odometry device, a main computer and a radio communication device, the first and second subsystems being connected to one another by at least one local communication network.

The invention also relates to a method for using an automatic train control system according to the preceding system, characterized in that it consists, when the on board ATC is a "standby" operating mode, of iterating the steps consisting of measuring a movement of the train between a current iteration and a preceding iteration and verifying that the measured movement is zero, and in the affirmative, sending the ground ATC an instantaneous position of the train at least at a switching moment from the "standby" operating mode to the "active" operating mode.

According to other advantageous aspects of the invention, the method comprises one or more of the following features, considered alone or according to all technically possible combinations:

- in the negative, invalidating the instantaneous position of the train and not send the ground ATC an instantaneous position of the train until a predetermined moment, advantageously corresponding to the detection of a positioning beacon, placed along a railway track on which the train is traveling.
- when the on board ATC is in a "standby" operating mode, the instantaneous position of the train is a position recalculated by the on board ATC upon each iteration.
- when the on board ATC is in a "standby" operating mode, the instantaneous position of the train is a position calculated by the on board ATC before switching into the "standby" operating mode.
- during the switching of the on board ATC from the "standby" operating mode to the "active" operating mode, if the on board ATC has not detected movement of the train while it was in the "standby" mode, the instantaneous position of the train is used as instantaneous position thereof for the "active" operating mode and, if the on board ATC has detected a movement of the train while it was in the "standby" mode, the method comprises a phase for initializing the instantaneous position of the train before switching to the "active" operating mode.

BRIEF DESCRIPTION OF THE DRAWINGS

The invention and its advantages will be better understood upon reading the following detailed description of one particular embodiment, provided solely as an illustrative and non-limiting example, this description being done in reference to the appended drawings, in which.

DETAILED DESCRIPTION

Figure 1:
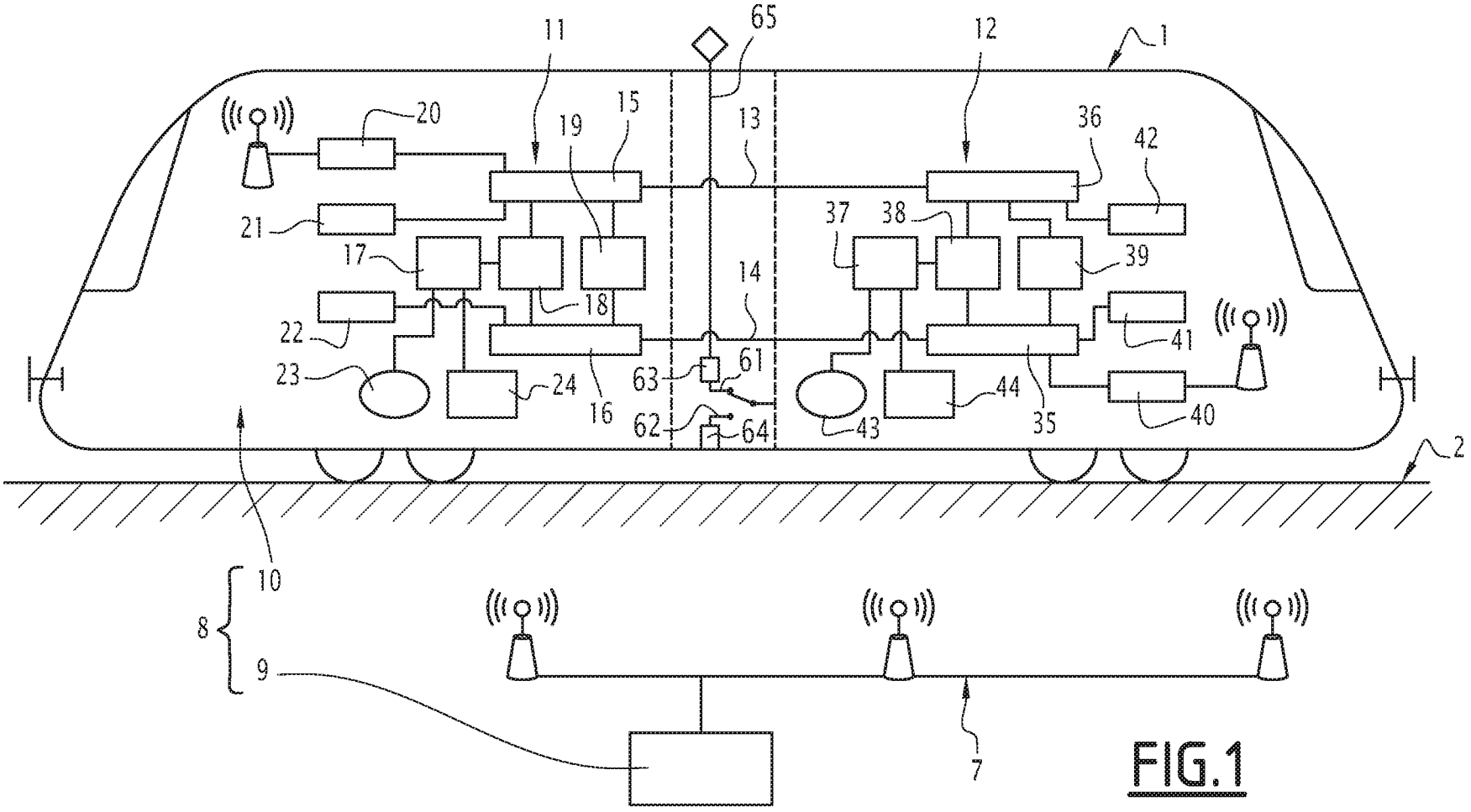
FIG. 1 is a schematic block illustration of an on board ATC in the "active" operating mode.

FIG. 1 shows an ATC system 8 including a ground ATC 9 and an on board ATC 10, which is on board a train 1 traveling on a track 2.

The on board ATC 10 is more particularly outlined. In a redundant configuration, it includes, for operation in an "active" mode, a first subsystem 11 and a second subsystem 12 that are identical to one another. Alternatively, in a simple and non-redundant configuration, the on board ATC 10 includes only one subsystem, 11 or 12.

The first subsystem 11 is installed at a first end of the train 1, for example the head of the train (the train 1 moving from right to left in FIG. 1), while the second subsystem 12 is installed at a second end of the train 1, for example a tail end of the train.

The first subsystem 11 and the second subsystem 12 are connected to one another by a first communication network 13 and by a second communication network 14.

The first and second communication networks 13, 14 are for example local networks of the Ethernet type.

The first subsystem 11 includes a first switch 15, a port of which is connected to the first communication network 13, and a second switch 16, a port of which is connected to the second communication network 14.

The first subsystem 11 includes a radio communication device 20, for example connected to a port of the first switch 15.

The radio communication device 20 includes a module connected to an antenna to allow the establishment of a wireless communication between the first subsystem 11 and an access point of a radio communication infrastructure 7 on the ground.

The first subsystem 11 also includes a wake-up unit 21 for the first subsystem 11, this wake-up unit for example being connected to a port of the first switch 15.

The wake-up unit 21 is for example capable of receiving a switching signal of the first subsystem from the active operating mode to the "standby" operating mode, or conversely from the "standby" operating mode to the "active" operating mode. This signal may for example be emitted by the ground ATC and received via the radio communication device 20. Alternatively, the signal may correspond to the fact that the train's conductor turns a security key in the active cabin and activates piloting of the train. In still another alternative, the wake-up unit incorporates an infrared receiver capable of receiving a switching signal emitted by a remote control used by an operator wishing to modify the operating mode of the train in one direction or the other.

The first subsystem 11 includes a main computer 18 advantageously connected on the one hand to a port of the first switch 15, and on the other hand to a port of the second switch 16. The main computer 18 constitutes the on board computer of the train 1 and is able to be programmed so as to perform different functionalities.

The first subsystem 11 includes an odometry device. This odometry device includes at least a detection member and acquisition electronics 17. In FIG. 1, the detection member is a phonic wheel 23 made up of a disc bearing a pattern and coupled to one of the wheels of the train 1 and an optical sensor coupled to a fixed part of the train 1 and able to detect the passage of the pattern borne by the disc. The raw signal generated by the phonic wheel 23 is applied at the input of the acquisition electronics 17, the latter being capable of calculating a movement property of the train.

The odometric device also includes an antenna 24, for example of the RFID type, capable of capturing the signals emitted by positioning beacons installed in the ground, for example between the two lines of rails of the track 2. The signals received by the antenna 24 are sent to the acquisition electronics 17, the latter being capable of processing them to extract the information transmitted by a beacon, such as an identifier of this beacon, the installation position of this beacon, etc.

In the "active" operating mode, the phonic wheel 23 makes it possible to determine the distance traveled by the train 1 from the last positioning beacon crossed and, from the position of this beacon, to determine the instantaneous position of the train, which the on board ATC next sends, via the communication module and the antenna, to the ground ATC.

Lastly, the first subsystem 11 includes an input/output interface 19 making it possible to connect, to the communication networks of the train, various sensors and actuators (not shown in the figures), for example a braking system of the train 1.

As shown in FIG. 1, the first subsystem 11 may also include a man/machine interface 22, for example connected to a port of the second switch 16. This man/machine interface 22 is installed in the head cabin of the train to be used by the conductor. Alternatively, in particular for a driverless train, such an interface is not provided.

A similar description could be done for the subsystem 12, which includes:

- first and second connectors 35, 36;
- a radio communication device 40;
- a wake-up unit 41;
- an odometry device including a phonic wheel 43 and an antenna 44 connected to acquisition electronics 37;
- a main computer 38;
- an input-output interface 39; and, optionally
- a man/machine interface 42.

In a known manner, the power supply of the on board ATC system 10 is done by two low-voltage power lines. The first power line 61 is connected via a converter 63 to the high-voltage power line 65 of the train.

The second power line 62 is connected to a battery 64 adapted so as, in case of interruption of the high-voltage power supply of the train, to allow the operation of the on board ATC system 11.

According to the invention, the on board ATC system 10 can be placed in a standby operating mode.

Figure 2:
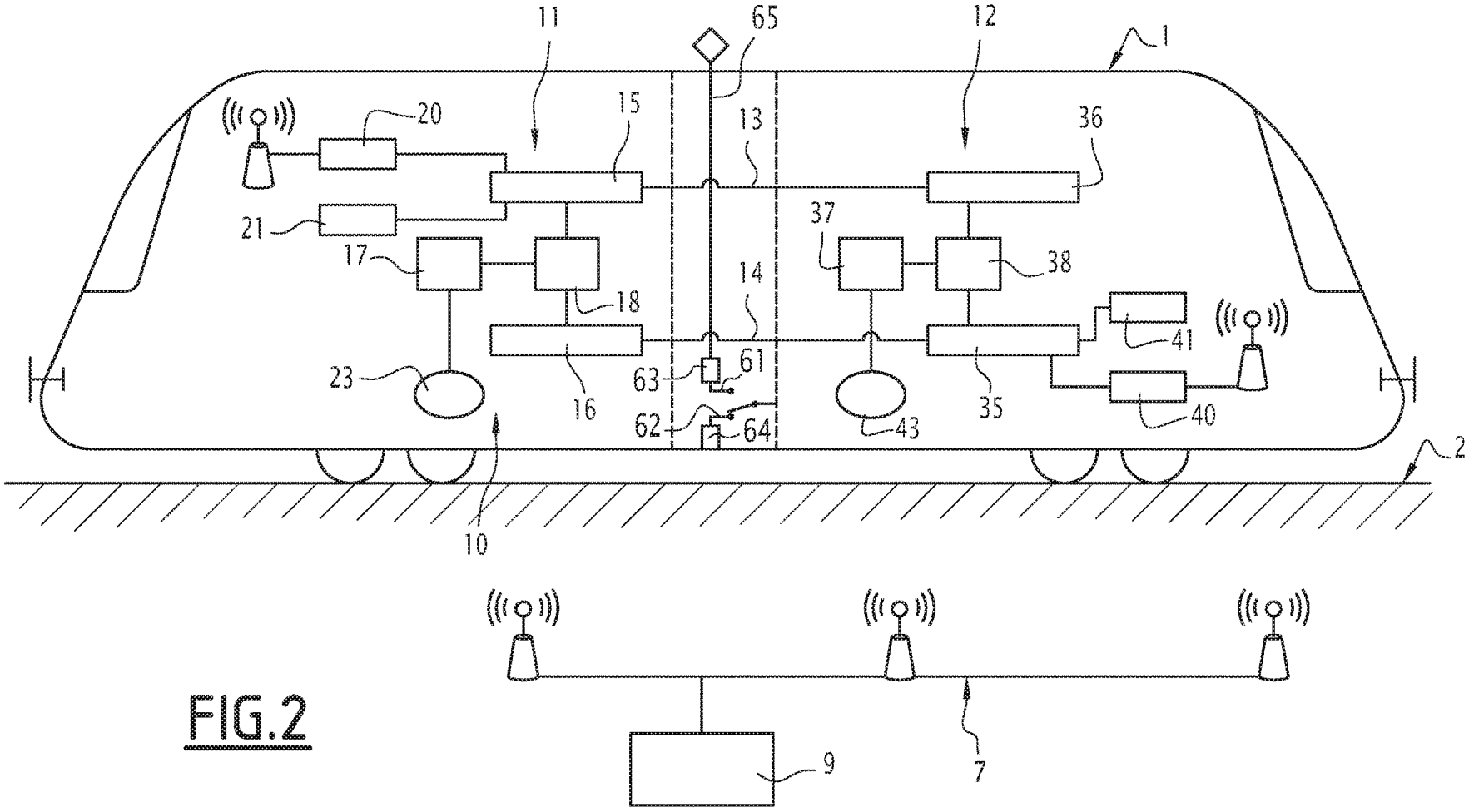
FIG. 2 is a schematic illustration of an on board ATC according to the invention in the "standby" operating mode.

In this operating mode, only the components shown in FIG. 2 are kept powered on and then supplied by the battery 64.

Symmetrically for the first and second subsystems 11 and 12, this involves the first and second switches 15, 16 and 35, 36, the radio communication devices 20 and 40, the wake-up unit 21 and 41, the main computer 18 and 38, and, from among the odometry device, the phonic wheel 23 and 43 and the acquisition electronics 17 and 37 of the signal delivered by the corresponding phonic wheel.

Thus, the input/output interface 19 and 39 for connecting to other systems of the train, the man/machine interface 22 and 42 in the cabin and the antenna 24 and 44 of the odometry device are deactivated.

In reference to FIG. 3, a method for using the ATC system 8 will now be described.

The phase 100, which corresponds to the "active" operating mode, comprises a step 110, during which the on board ATC, for example the subsystem 11, determines the instantaneous position of the train from signals received from the odometry device, i.e., both from the antenna 24 to recover the position of the last beacon crossed and the phonic wheel 23 so as to determine the distance traveled since this last beacon was crossed.

Next, during a step 120, the determined instantaneous position is stored in a random-access memory of the main computer 18.

Lastly, in step 130, this updated instantaneous position is sent to the ground ATC, via the radio communication device 20 and the radio communication infrastructure 7 on the ground.

Steps 110, 120 and 130 are repeated periodically.

The phase 200 begins when the wake-up unit 21 of the train 1 receives a switching signal from the "active" operating mode to the "standby" operating mode. This control signal is for example emitted by the ground ATC 9 via the infrastructure 7 and the radio communication device 20.

In step 210, the wake-up unit 21 asks the main computer 18 to verify a certain number of conditions to allow the on board ATC to be placed in standby. For example, it is verified that the train has no current assignment to carry out; the instantaneous position on the railway network corresponds to a garage track (the random-access memory of the main computer 18 including a description database of the railway network); or that the train is stopped, i.e., that no movement is detected by the odometry device.

Once these various conditions are verified, in step 220, the train, on command from the main computer 18, interrupts the power supply of the input/output interface 19, the man/machine interface 22 in the cabin and the short-range communication antenna 24 with the positioning beacons on the track.

Once these operations are carried out, in step 230, the wake-up unit 21 sends the ground ATC 9 an acknowledgment message indicating that the train 1 has been placed in the "standby" operating mode. This message is transmitted by the radio communication device 20.

The train 1 being parked and the on board ATC system being in the "standby" operating mode, the following steps take place during the phase 300.

In step 310, from signals received from the phonic wheel 23 and processed by the acquisition electronics 17, the main computer 18 determines a movement d of the train from the last iteration of the step 310.

In step 320, it is verified whether this movement d is zero (optionally to within a measurement margin).

In the affirmative, i.e., if this movement d is zero, then in step 330, the main computer 18 computes the position F of the train. This position is computed, like in the "active" mode, from the total movement since the last beacon crossed (i.e., the last beacon crossed in the "active" mode before switching into the "standby" mode). Since the movement is zero since the switching to the "standby" mode, this instantaneous position F is also the last instantaneous position determined by the on board ATC in the "active" mode.

Advantageously, the on board ATC in "standby" mode communicates this instantaneous position F to the ground ATC each time it recalculates it. In this way, the ground ATC knows the position of the trains stopped on the network and may account for this in supervising the traffic of the other traveling trains. Security is therefore enhanced.

Steps 310, 320 and 330 are iterated periodically.

If, in step 320, it is determined that the movement d of the train is nonzero, i.e., if the train has been moved for one reason or another since the last iteration of the step 310, then in step 340, the main computer 18 invalidates the instantaneous position F of the train, which is henceforth undefined for the main computer 18. This is symbolized by the expression "F==0" in FIG. 3. The latter ceases to send the ground ATC position information for the train.

When one wishes to restart the train 1 and switch the on board ATC 10 from the "standby" mode to the "active" mode, the wake-up phase 400 of the train is initiated by the reception of a suitable command signal by the wake-up unit 21.

In step 410, the wake-up unit 21 commands the main computer 18 to turn on the train by powering on all of the equipment that is off (input/output interface, man/machine interface, communication antenna with the positioning beacons on the ground).

In step 420, the on board ATC verifies whether the instantaneous position F of the train is defined.

In the affirmative, i.e., if there has been no movement d while the on board ATC was in standby, then in step 430, the main computer 18 sends the ground ATC the instantaneous position F of the train.

In this way, the ATC is immediately placed in the "active" operating mode and the train is fully supervised (step 440).

However, if, in step 420, it is observed by the on board ATC that the instantaneous position F of the train is undefined, then in step 450, the train 1 is moved by sight until it crosses a positioning beacon from which the on board ATC will be capable of calculating the instantaneous position of the train. It is only at this moment and with this instantaneous position information of the train that the on board ATC is switched into the "active" operating mode, it communicates an instantaneous position of the train to the ground ATS and the travel of the train can be supervised by the ATS and controlled safely by the ATC (step 440).

Alternatively, in step 340, noting that it has not received any more position information of the train for several periods, the ground ATC 9 places a flag for the "train remained immobile" (zero) state at "train moved" (one).

In this alternative, when one wishes to restart the train 1 and switch the on board ATC 10 from the "standby" mode to the "active" mode, a wake-up command is developed during the phase 400. To that end, the ground ATC reads the current value of the flag and compares it to the zero value. If the flag has the zero value, indicating that the train 1 has not been moved while it was parked and its on board ATC is "in standby", the ground ATC indicates in the wake-up command that the on board ATC may consider the value of the position of the train to be stored in the main computer 18 as instantaneous position of the train to initialize the "active" operating mode. Conversely, if it is noted that the flag assumes the unit value, indicating that the train 1 has been moved while its on board ATC was "in standby", the ground ATC develops a wake-up command indicating to conduct an initialization phase for the instantaneous position of the train.

Alternatively, to still further reduce the electricity consumption in "standby" mode, and since the first and second subsystems are redundant, it is possible to consider keeping only one of the two subsystems supplied with power. However, this embodiment has the weakness of not being able to allow the detection, when the train is parked and the on board ATC is in standby, of the unhitching of one or several cars from the cabin, whose subsystem is kept in standby.

Conversely, the embodiment described in detail above makes it possible, at any time, to verify the integrity of the train, for example by having a toggle bit travel along the first and second communication networks 13 and 14 between the first and second subsystems 11 and 12, so as to guarantee that the communication networks of the train are functional, and consequently that the cars of the train are not unhitched. This information regarding the integrity of the train can advantageously be sent to the ground ATC at the same time as the position of the train, for example when the train is woken up.

In another alternative independent of the previous one, the position of the train sent at each moment from the on board ATC to the ground ATC in the "standby" operating mode is the instantaneous position of the train, calculated by the main computer before switching from the "active" operating mode to the "standby" operating mode.

Thus, the present invention has the following advantages:

It offers increased availability, since the train, when it is restarted, is immediately capable of knowing its precise instantaneous position and traveling without manual intervention. This is particularly advantageous in the case of a driverless automatic subway.

The determination of the instantaneous position upon waking up of the train is obtained safely. It is in fact not possible to use an incorrect instantaneous position to calculate a movement authorization.

Lastly, the on board ATC, to be able to carry out the method as previously described, is only very slightly modified relative to those of the state of the art. This simply involves defining the components that should be turned off when switching from the "active" mode to the "standby" mode and reprogramming the main computer so that it verifies the movement of the train from information obtained by the phonic wheel, and periodically resending the position of the train as long as it has not moved or invalidating the position of the train once it has moved.

Figure 3:
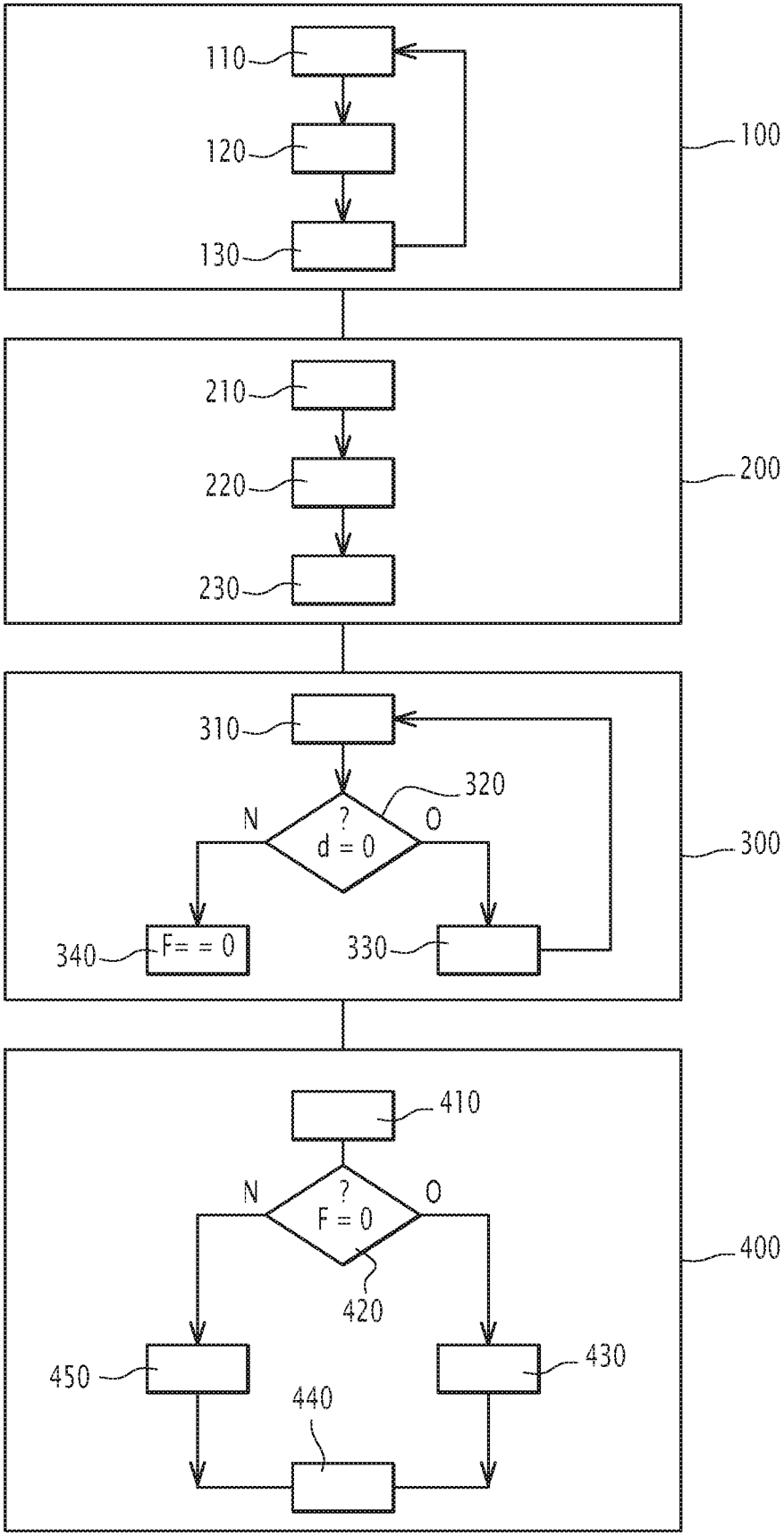
FIG. 3 is a schematic illustration of a method according to the invention.

It should be noted that in the advantageous embodiment described in FIG. 3, the on board ATC determines the validity of the calculated current position independently of the ground ATC, which may therefore fall out of order or be reset without losing the information allowing a train to restart immediately in supervision mode.

The invention claimed is:

1. An automatic train control system of the type with communication-based train management, including a ground component, called a ground ATC, and an on board component that is on board a train, called an on board ATC, wherein the on board ATC is able to be switched from an "active" operating mode to a "standby" operating mode and vice versa through a wake-up unit, and in that, in the "standby" operating mode, only the following components remaining supplied with electricity using an electrical power source:

an odometry device measuring a movement of the train;

a main computer; and a radio communication device between the on board ATC and the ground ATC;

wherein the main computer being programmed so as, in the "standby" operating mode, to verify that the movement of the train measured by the odometry device from a switching moment from the "active" operating mode to the "standby" operating mode is zero and, in the affirmative, to send the ground ATC an instantaneous position of the train using the radio communication device, at least at a switching moment from the "standby" operating mode to the "active" operating mode.

2. The system according to claim 1, wherein, in the negative, the main computer is able to invalidate the instantaneous position of the train and not send the ground ATC an instantaneous position of the train until a predetermined moment, corresponding to the detection of a positioning beacon, placed along a railway track on which the train is traveling.

3. The system according to claim 1, wherein the instantaneous position of the train sent from the on board ATC to the ground ATC is an instantaneous position of the train determined by the main computer.

4. The system according to claim 1, wherein the odometry system includes a detector detecting the movement of the train, the detector comprising a phonic wheel and acquisition electronics connected to the computer.

5. The system according to claim 1, wherein said on board ATC includes a first subsystem and a second subsystem, the second subsystem being redundant relative to the first subsystem, each subsystem including an odometry device, a main computer and a radio communicator, the first and second subsystems being connected to one another by at least one local communication network.

6. A method for using an automatic train control system of the type with communication-based train management, including a ground component, called a ground ATC, and an on board component that is on board a train, called an on board ATC, wherein the on board ATC is able to be switched from an "active" operating mode to a "standby" operating mode and vice versa through a wake-up unit, and in that, in the "standby" operating mode, only the following components remaining supplied with electricity using an electrical power source: an odometry device measuring a movement of the train, a main computer, and a radio communication device between the on board ATC and the ground ATC, the method comprising:

when the on board ATC is the "standby" operating mode, iterating the steps consisting of measuring a movement of the train between a current iteration and a preceding iteration and verifying that the measured movement is zero, and in the affirmative, sending the ground ATC an instantaneous position of the train at least at a switching moment from the "standby" operating mode to the "active" operating mode.

7. The method according to claim 6, consisting, in the negative, invalidating the instantaneous position of the train and not send the ground ATC an instantaneous position of the train until a predetermined moment, corresponding to the detection of a positioning beacon, placed along a railway track on which the train is traveling.

8. The method according to claim 6, wherein, when the on board ATC is in a "standby" operating mode, the instantaneous position of the train is a position recalculated by the on board ATC upon each iteration.

9. The method according to claim 6, wherein, when the on board ATC is in a "standby" operating mode, the instantaneous position of the train is a position calculated by the on board ATC before switching into the "standby" operating mode.

10. The method according to any claim 6, wherein during the switching of the on board ATC from the "standby" operating mode to the "active" operating mode, if the on board ATC has not detected movement of the train while it was in the "standby" mode, the instantaneous position of the train is used as instantaneous position thereof for the "active" operating mode and, if the on board ATC has detected a movement of the train while it was in the "standby" mode, the method comprises a phase for initializing the instantaneous position of the train before switching to the "active" operating mode.

* * * * *